US006371132B1

(12) United States Patent
Lacout

(10) Patent No.: US 6,371,132 B1
(45) Date of Patent: Apr. 16, 2002

(54) MULTIPLE-SHAPE APPLICATION DEVICE, SYSTEM, AND METHOD

(75) Inventor: Frank Lacout, Draveil (FR)

(73) Assignee: L'Oreal (FR)

( * ) Notice: Subject to any disclaimer, the term of this patent is extended or adjusted under 35 U.S.C. 154(b) by 0 days.

(21) Appl. No.: 09/564,791

(22) Filed: May 5, 2000

(30) Foreign Application Priority Data

May 5, 1999 (FR) ..... 99 05712

(51) Int. Cl.[7] ..... A45D 40/26
(52) U.S. Cl. ..... 132/320; 15/244.2
(58) Field of Search ..... 132/320, 301, 132/317, 156; 15/229.3, 229.4, 244.1, 244.2

(56) References Cited

U.S. PATENT DOCUMENTS

| | | | | |
|---|---|---|---|---|
| 2,100,855 A | * | 11/1937 | Kelly | 15/229.4 |
| 3,737,939 A | * | 6/1973 | Jones, Sr. | 15/244.2 |
| 4,446,880 A | | 5/1984 | Gueret et al. | |
| 4,506,404 A | | 3/1985 | Clay | |
| 4,545,393 A | * | 10/1985 | Gueret et al. | 132/320 |
| 4,701,168 A | | 10/1987 | Gammons | |
| 4,869,612 A | | 9/1989 | Mooney et al. | |
| 4,893,956 A | * | 1/1990 | Wojcik et al. | 15/244.2 |
| 5,137,038 A | * | 8/1992 | Kinsford | 132/320 |
| 5,285,799 A | | 2/1994 | Minard | |
| 5,432,972 A | * | 7/1995 | Polzin et al. | 15/244.1 |
| 5,615,440 A | * | 4/1997 | Cowan et al. | 15/244.2 |
| 5,937,873 A | | 8/1999 | Schlosser et al. | |

FOREIGN PATENT DOCUMENTS

| | | |
|---|---|---|
| EP | 0 826 321 | 3/1998 |
| WO | WO 85/03447 | 8/1985 |

* cited by examiner

*Primary Examiner*—Todd E. Manahan
(74) *Attorney, Agent, or Firm*—Finnegan, Henderson, Farabow, Garrett & Dunner, L.L.P.

(57) ABSTRACT

An application device for applying a product to a surface, include an applicator member and a grip. The applicator member has a deformable application surface arranged substantially in a plane. The surface has a first shape substantially parallel to the plane in an undeformed state of the applicator member and a second shape substantially parallel to the plane in a first deformed state of the applicator member. The grip has a linking element on the applicator member and at least one actuation element coupled to the linking element. The grip is configured to deform the application surface from the undeformed state to the first deformed state in response to a first force applied to the actuation element.

51 Claims, 4 Drawing Sheets

MULTIPLE-SHAPE APPLICATION DEVICE, SYSTEM, AND METHOD

The present invention relates to a device for applying a product, such as a make-up product, to a surface, particularly the skin. The invention is particularly suited for the treatment and/or making-up of the eyelids.

It is known to apply a make-up product, for example an eyeshadow, by means of an elongate, asymmetrical applicator delimited by two lateral edges, one forming a first radius of curvature and the other forming a second radius of curvature which is smaller than the first radius of curvature. The larger radius of curvature is adapted for the upper part of the eyelid, whilst the smaller radius is adapted for the lower edge of the eyelid. The applicator is formed from a relatively rigid support on which a sheet of foam, suitable for being loaded with product and forming a substantially planar application surface, is mounted. Because of the symmetrical orientation of the lid of the right eye with respect to that of the left eye, the use of an applicator of asymmetrical form of this type requires the use of a first applicator for the right eye and a second applicator for the left eye. All this substantially increases costs, poses problems of overall size and packaging, and multiplies the risks of losing one or other of the applicators.

It is also known from U.S. Pat No. 4,701,168 to produce an applicator of which the surface is deformable from a planar form to a domed or curved form. The surface is deformed perpendicularly to its starting plane so that the initially flat surface is no longer flat, but rather has been bent out-of-plane. In fact, the arrangement of the deforming means or upright members allows only this type of deformation. It is not possible for such an applicator configuration to be made suitable for the application of a product to different surfaces oriented in an opposite manner from each other, such as the right eyelid and the left eyelid.

A similar problem arises in the case of the treatment and/or making-up of other parts of the body or of the face. For instance, applicators having oppositely oriented surfaces are preferable for treating crow's feet at the corner of the eyes or bags and dark shadows under the eyes.

Accordingly, one of the preferred objects of the invention is to provide an application device which solves some or all of the abovementioned problems with regard to conventional devices.

It is, in particular, a preferred object of the invention to provide an application device which is suitable for applying a product, for example a make-up product, to surfaces with different contours.

It is a further preferred object of the invention to provide an application device suitable, in particular, for applying a product to at least two surfaces with asymmetrical contours oriented symmetrically with respect to each other.

It is an even further preferred object of the invention to provide an application device suitable both for treating and/or making-up the lid of the right eye and the lid of the left eye.

It is yet an even further preferred object of the invention to provide an application device that is simple to use and economical to produce.

It is still a further preferred object of the invention to provide a container, particularly a make-up case, which incorporates an application device according to the invention.

It should be understood that the invention could still be practiced without performing one or more of the objects and/or advantages described above. Still other objects will become apparent from the detailed description which follows.

To achieve those and other advantages, and in accordance with the purposes of the invention, as broadly described herein, the invention includes an application device for applying a product, including an applicator member and a grip on the applicator member. The applicator member is formed at least partially of a deformable material and has an application surface arranged substantially in a plane. The application surface has a first shape substantially parallel to the plane when the applicator member is undeformed and a second shape substantially parallel to the plane when the applicator member is deformed. In a preferred embodiment, the grip has a linking element on the applicator member and at least one actuation element coupled to the linking element. The grip is configured such that force applied to the grip deforms the application surface from the first shape to the second shape.

Preferably, the applicator member is substantially planar, at least when the applicator member is in the rest position or undeformed state. The applicator member may include a surface element having the application surface thereon. The surface element also is substantially planar in its rest position or undeformed state. In practice, in this rest position or undeformed state, the application surface on the surface element may be, in particular, slightly domed. The surface element may also have certain reliefs suitable, in particular, for facilitating its loading with product and/or for allowing a massaging effect. Furthermore, the surface element may be deformable in the thickness direction. During contact with a surface to be treated, the surface element may, on account of the deformability in the thickness direction, be more or less indented or contoured in order to shape its surface to the profile of the surface to be treated.

An elastic return force may be developed within the applicator member due to the deformation of the applicator member. This elastic return force, which may assist in the return of the application surface to the first form or undeformed state, may be generated, at least partially, by the elasticity of the material forming the applicator member. Similarly, an elastic return force may be developed within the grip due to the deformation of the grip. Thus, the elastic return force may be generated by the elasticity of the structure or material forming the grip. Preferably, the elastic return force is generated by the elasticity of the applicator member in combination with the elasticity of the grip. Preferably, the elastic return force generated by deforming the grip is greater than the return force generated by deforming the applicator member. Even more preferably, the elastic return force generated by the grip is substantially greater than the elastic return force generated by the applicator member.

With the application device according to the invention, it is advantageously possible to use the same application device for applying a product, for example a make-up product, to surfaces with different contours. The application device according to the invention is preferably economical to produce and simple to use. The case or other packaging for transportation and for protection of the application device and of the product to be applied, for example in a handbag, is small in terms of overall size and of simplified design compared with the overall size and design of a case having to contain a plurality of applicators.

According to a preferred embodiment of the invention, the planar forms or shapes of the applicator member, application surface, and/or the surface element may assume a first geometry in the undeformed state and a second (or even third) different geometry in the deformed states. This is particularly the case, when a planar form or shape with straight edges is deformed in order to become a planar form or shape with curved edges. According to another preferred embodiment, the shapes of the applicator member, application surface, and/or the surface element may assume a first geometry in the undeformed state and an identical, but differently oriented geometry in the deformed state. For instance, a first form or shape of the surface element may be the mirror image of a second form or shape of the surface element.

According to a particular preferred embodiment, the application surface is configured for transforming from the first form or shape to a second form or shape constituting the mirror image of the first form. For example, in its first form the application surface may be adapted to the treatment of the lid of the right eye, and in the second form, the application surface may be adapted for the treatment of the lid of the left eye.

Advantageously, according to another particular preferred embodiment, the first form or shape of the application surface is symmetrical with respect to an axis of symmetry. Actuation of the grip selectively causes the shape of the application surface to transform from the first form or shape to a second form or even a third form. Preferably, the second and third forms are asymmetrical, one constituting the mirror image of the other. Thus, by giving the application surface the second form, it is possible, for example, to make up the lid of the right eye. By giving the application surface the third form, it is possible to make up the lid of the left eye with one and the same applicator. In its first form, the application surface may be used advantageously for the treatment of another part of the body or face.

According to a specific preferred embodiment, in the first form, the shape of the application surface is at least partially defined by two lateral edges that are substantially straight and extend from a first end to a second end of the application surface. The two lateral edges may progressively diverge from each other in the direction of the second end. The first and second ends of the application surface may be rounded with the second end having a radius of curvature which is greater than a radius of curvature of the first end.

According to another preferred embodiment, in the second and third forms, the shape of the application surface forms a first lateral edge having a first radius of curvature and a second lateral edge forming a second radius of curvature. In this embodiment, one of the radii of curvature is preferably greater than the other radius of curvature. Advantageously, the lateral edge having the greater radius of curvature when the shape of the application surface is in the second form becomes that which has the smaller radius of curvature when the section of the application surface is in the third form, and vice versa.

The grip may include at least one and preferably two relatively rigid or semirigid actuation elements and a linking element. The grip is preferably located on a side of the applicator member opposite the surface element. The actuation elements, preferably, are spaced from each other and extend substantially perpendicular to the plane of the surface element and/or the plane of the applicator member. In a preferred embodiment, the linking element is located between and coupled to the actuation elements.

Each of the two actuation elements preferably has a first actuation site such that a force or pressure exerted on the first actuation sites of the side elements brings these first actuation sites closer together. In a preferred embodiment, bringing the first actuation sites closer to each other causes the cross-sectional shape of the surface element to transform from the first form to the second form. Each of the two actuation elements also preferably has a second actuation site such that a force or pressure exerted on the second actuation sites brings these second actuation sites closer together. In a preferred embodiment, bringing the second actuation sites closer to each other causes the cross-sectional shape of the surface element to transform from the first form to the third form. Thus, the passage of the surface element from one form to another may be performed by means of a very simple hand movement.

Preferably, the first actuation element is arranged in a first side plane oriented substantially perpendicular to an axis of symmetry of the applicator member. Similarly, the second actuation element is preferably arranged in a second side plane apart from and substantially parallel to the first side plane. In keeping with the spirit of the invention, the actuation elements need not be planar, symmetrical, or mirror images of each other.

According to an even further preferred embodiment of the invention, the two actuation elements are connected by a linking element. The linking element may be formed in a plane containing the axis of symmetry of the applicator member and may be perpendicular to the first and second actuation element planes. In this configuration the grip may form, substantially, an H-shape. The linking element is configured to flex elastically in a first direction in response to a force or pressure exerted on the first actuation sites, so as to bring these first actuation sites closer to each other. The linking element may also be configured to flex elastically in a second direction, for instance, opposite to the first direction, in response to a force or pressure exerted on the second actuation sites, so as to bring these second actuation sites closer to each other.

The edge of the linking element that faces the applicator member is preferably at least partially embedded in the mass of the applicator member. Advantageously, the linking element is embedded in the applicator member without causing an increase in thickness of the applicator member or extending into the application element. The passage from one form or cross-sectional shape to the other of the applicator member and/or the application element due to the flexing of the linking element is thus enhanced. The grip and, in particular, the linking element, may be attached to the applicator member by any suitable means, for example by means of adhesive bonding, welding or another mechanical attachment.

Preferably, the actuation elements are connected to the linking element by chamfered portions configured to promote the flexing of the linking element in the first and second directions. Advantageously, four such chamfered portions are provided.

In another preferred embodiment, at least one locking mechanism may be provided for removably locking the surface element in a undeformed state. Such a locking mechanism may include a first hook arranged on a side of one of the actuation elements. The first hook is preferably connected to the first actuation element by, in particular, a film hinge and configured to reversibly snap-fit onto the second actuation element. The locking mechanism may include a second hook located on the side of the grip opposite the first hook. The second hook may be connected, for instance, to the second actuation element by a film hinge and configured to reversibly snap-fit onto the first actuation element.

The grip including, if appropriate, the locking mechanism, may be formed from a single piece of a relatively rigid or semi-rigid thermoplastic material, for example a polypropylene or a polyethylene. Furthermore, the grip may be obtained by a molding operation.

Preferably, the linking element is thinner and/or more flexible than the first and second actuation elements so as to facilitate the flexing of the linking element relative to the actuation elements.

The applicator member may be formed from a thermoplastic elastomer based, in particular, on polypropylene or polyethylene. Suitable materials include those marketed under the SANTOPRENE® or KRATON® brand names. Preferably, the grip and the applicator member are formed by two-shot injection molding or overmolding.

Advantageously, the surface element of the applicator member is formed from an absorbent material, for example an open-cell or semi-open-cell foam. An absorbent material of this type, configured, in particular, in the form of a relatively thin layer, may be bonded adhesively to the applicator member. Alternatively, the applicator member may form a unitary structure with the surface element, made from one and the same material.

Another aspect of the invention relates to a system including the applicator device and a container containing the device. In a preferred embodiment, the system includes a make-up case containing, for example in a compartment provided for this purpose, the application device. A case of this type also, typically, includes at least one other compartment configured to contain the product to be applied, for example, a cosmetic product in the form of a solid cake or of a loose powder, such as eye make-up.

In yet another aspect, a method of applying a product with the device is provided. One preferred practice of the method involves applying a cosmetic product, such as eye make-up, to a region, such as an eyelid.

Besides the structural arrangements and procedural aspects described above, the invention could include a number of other arrangements, such as those explained hereinafter. It is to be understood that both the foregoing description and the following description are exemplary, and are intended to provide further explanation of the invention as claimed.

The accompanying drawings are included to provide a further understanding of the invention and are incorporated in and constitute a part of this specification. The drawings illustrate embodiments of the invention and, together with the description, serve to explain the principles of the invention. In the drawings, FIG. 1A is a perspective view of an application device according to one preferred embodiment of the invention.

Figure 1A:
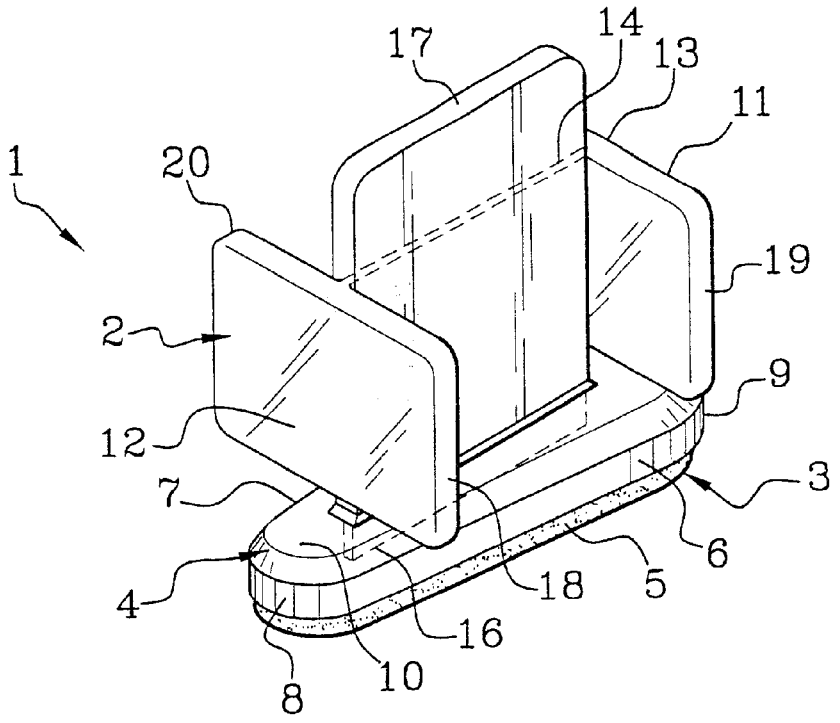
FIG. 1B is a cross-sectional rear view of the application device of FIG. 1A.

Reference will now be made in detail to the present preferred embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

Figure 1B:
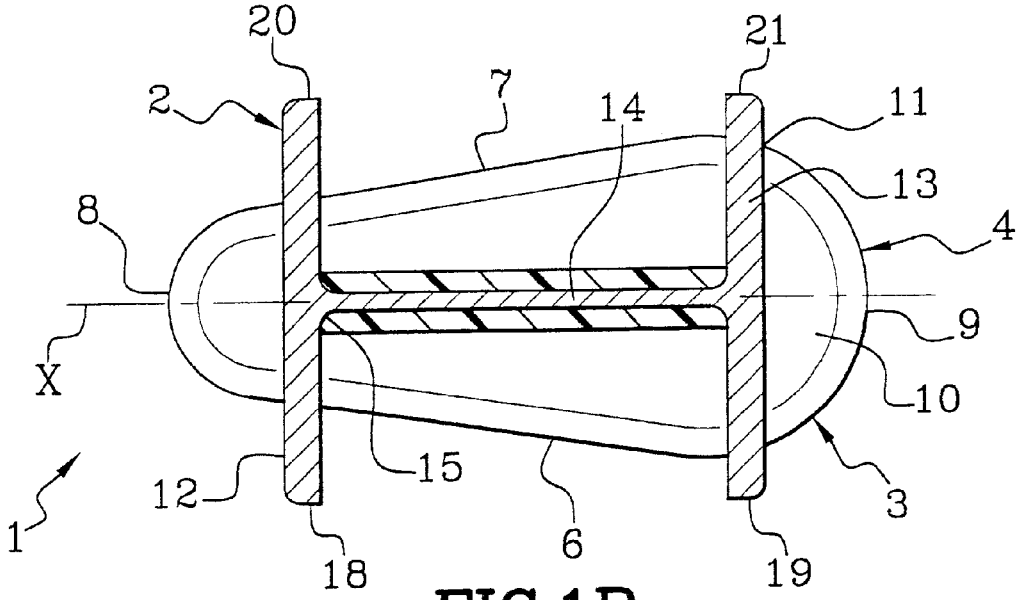

As shown in FIGS. 1A and 1B, the application device 1 is in its rest position or undeformed state. In this undeformed state, no force is exerted either on the grip 2 or on the surface element 3.

The application device 1 according to this embodiment of the invention comprises an applicator member 4 in the form of a planar element made from elastomeric material. The elastomeric material may be, for example, polypropylene or polyethylene. One of the planar faces of the applicator member 4 forms an application surface 5. The applicator member may include a surface element 3 having the application surface 5 thereon. Surface element 3 may be formed from a sheet of an absorbent and deformable material, for example a foam, suitable for being loaded with product to be applied, for example, an eyeshadow, and for placing the product on the surface to be treated, for example, the skin. The sheet may be adhesively bonded to the corresponding face of the applicator member 4.

Figure 4A:
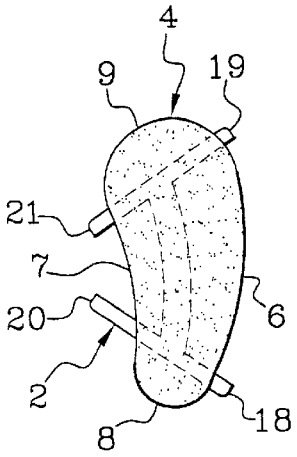
FIG. 4A is a front view of the application element of the application device of FIG. 1A having a first cross-sectional shape.
Figure 4B:
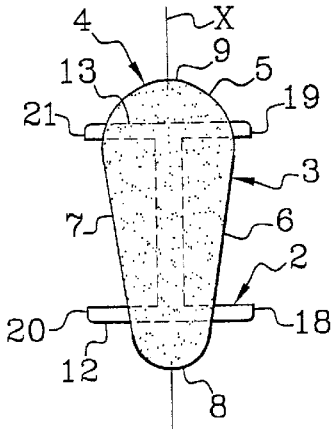
FIG. 4B is a front view of the application element of the application device of FIG. 1A having a second cross-sectional shape.

As is shown in FIG. 1B and in FIG. 4B (representing the surface element 3, seen front-on), the section of the surface element 3, parallel to its plane, is of elongate shape and symmetrical with respect to an axis X. The surface element 3 is defined, at least in part, by two lateral edges 6, 7. The edges 6, 7 are substantially straight and diverge from each other from a first rounded end 8 towards a second rounded end 9. The rounded end 9 has a radius of curvature greater than the radius of curvature of the rounded end 8.

On the planar side 10 of the applicator member 4, opposite the surface element 3, the applicator member 4 is integral with a grip 2. The grip 2 may be formed from an H-shaped structure 11. The structure 11 is preferably formed of a relatively rigid or semi-rigid material, for example polypropylene. The H has two side actuation elements 12, 13 intended to form, as will be seen in greater detail below, elements for receiving the applied force or pressure and for transmitting that applied force to the applicator member 4. The actuation elements 12, 13 are attached to either end of a linking element 14. The linking element 14 is perpendicular to the actuation elements 12, 13. Moreover, the linking element 14 is preferably thinner, and less stiff, than the actuation elements 12, 13. Thus, the linking element 14 forms a zone which flexes in response to a force or pressure exerted on the actuation elements 12, 13. Preferably, the force or pressure is exerted on the actuation sites 18, 19 (or 20, 21) located on or near the side edges of the actuation elements 12, 13. As is clearly apparent from FIG. 1B, the actuation elements 12 and 13 are connected to the linking element 14 via chamfered portions 15. These chamfered portions 15 are configured to promote the flexing of the structure 11, and in particular, the flexing of the linking element 14, in response to a force or pressure exerted on one side or the other of the structure.

The H-shaped structure 11 and the applicator member 4 could be assembled by means of overmolding or two-shot injection molding, preferably using materials which are mutually compatible and which will bond together at the injection temperature. In practice, the lower edge of the actuation elements 12, 13 are located a distance (approximately 1 to 2 mm) from the face 10 of the applicator member 4. The lower edge 16 of the linking element 14 extends beyond the lower edge of the side elements 12, 13. During molding of the application device, the lower edge 16 may be embedded in the mass of the material forming the applicator member 4 without however extending into the surface element 3.

The linking member 14 is perpendicular to the surface element 3 and is arranged along the axis X when the surface element 3 is in the rest or undeformed position illustrated in FIGS. 1A and 1B. The actuation elements 12, 13 are perpendicular to the linking element 14 and to the surface element 3. The upper edge of the linking element 14 ends at the same level as the actuation elements 12, 13. The elastomeric material forming the applicator member 4 covers the two planar faces of the linking element 14 and forms a height extension 17 above the upper edge of the linking element 14. An arrangement of this type allows secure attachment of the H-shaped structure to the applicator member 4 when the materials used for producing the two components are non-compatible or only partially compatible.

By way of a specific illustrative embodiment adapted for making-up the eyelids, an applicator member 4 is produced from thermoplastic elastomer. The length of the applicator member 4 (and of the surface element 3) along the axis X is preferably of the order of 35 mm, and the maximum width of the applicator member 4 (and of the surface element 3) adjacent the rounded end 9 is preferably of the order of 15 mm. Preferably, the minimum width of the applicator member 4 (and of the application element 3) adjacent the rounded end 8 is of the order of 8 mm. The thickness of the applicator member 4 is of the order of 3 mm to 5 mm, for example. The H-shaped structure is preferably produced from polypropylene. The thickness of the actuation elements 12, 13 is of the order of 2 mm, for example. Their width perpendicular to the axis X is preferably on the order of 20 mm. The width of the linking element 14, along the axis X, is preferably on the order of 20 mm. The linking element's mean thickness is 1 mm, for example.

Figure 2A:
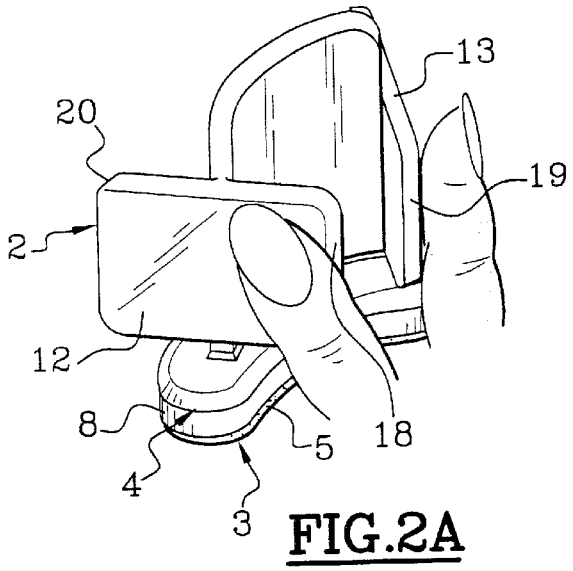
FIG. 2A is a perspective view of the application device of FIG. 1A as adapted for the application of a product to the lid of the right eye.
Figure 2B:
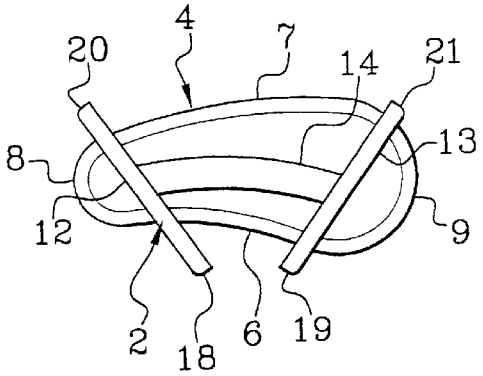
FIG. 2B is a rear view of the application device of FIG. 1A as adapted for the application of a product to the lid of the right eye.
Figure 4C:
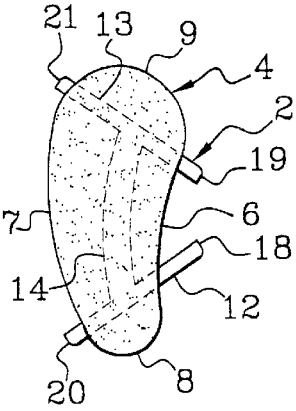
FIG. 4C is a front view of the application element of the application device of FIG. 1A having a third cross-sectional shape.

A description will now be given of the use of the application device discussed hereinabove for making up the lid of the right eye, with reference to FIGS. 2A–2B and 4C. As is apparent from these FIGS, the user holds the application device 1 between her thumb and forefinger and moves the actuation sites 18, 19 of the actuation elements 12, 13 closer together. Conversely, the actuation sites 20 and 21 of the actuation elements 12, 13 move farther away from each other. In doing this, the linking element 14 flexes correspondingly, thereby giving rise to an in-plane deformation of the applicator member 4 in which the lower edge 16 of the linking element 14 is partially embedded. The surface element 3 undergoes an in-plane flexing substantially identical to that of the applicator member 4. The cross-sectional shape of the surface element 3 is then asymmetrical, as is shown in the front view of FIG. 4C. Thus, the lateral edge 6 which, at rest, was straight, now forms a curve. The same applies to the lateral edge 7, which now forms a radius of curvature greater than the curvature of the lateral edge 6.

Figure 6:
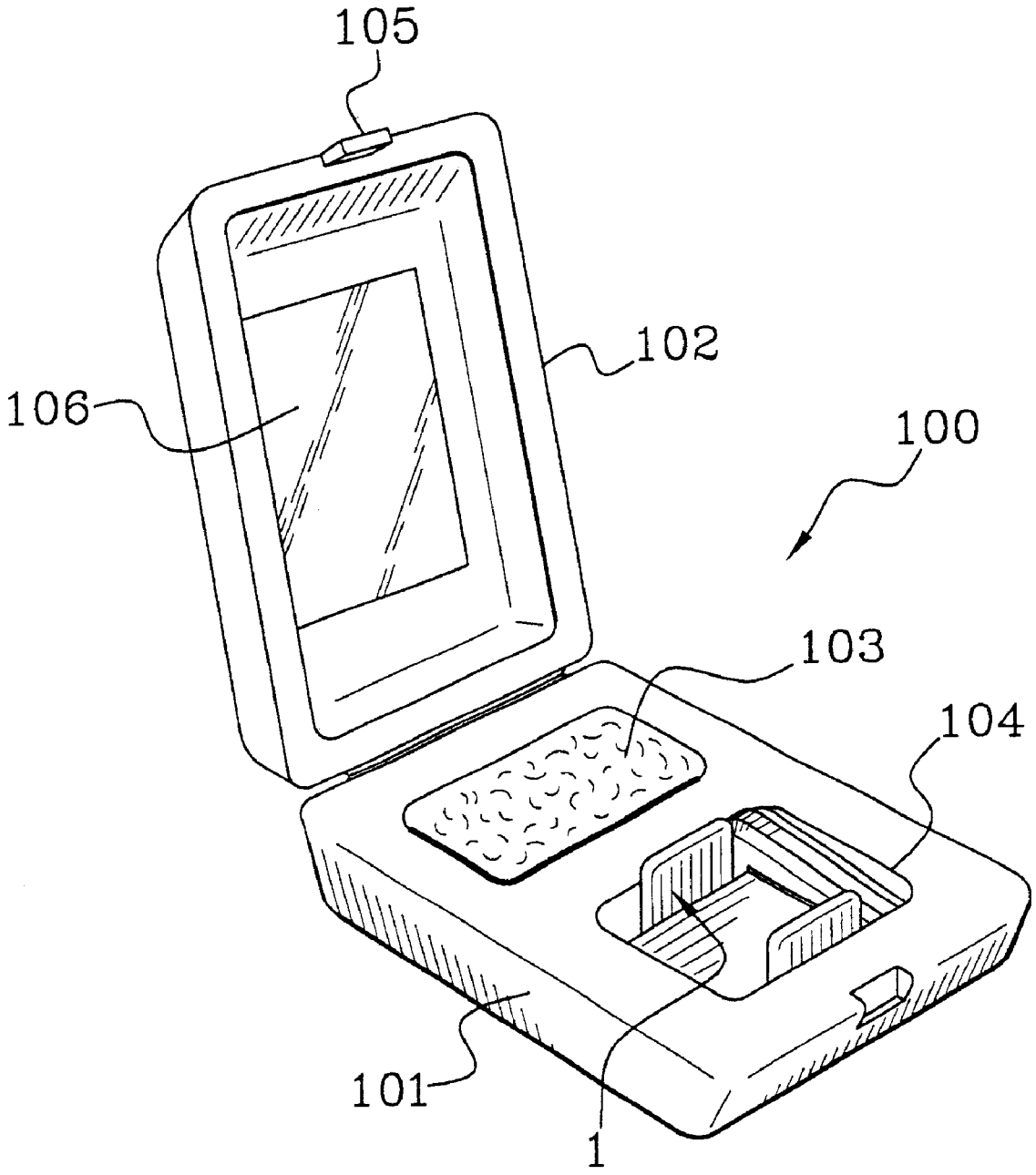
FIG. 6 is a perspective view of a case, particularly a make-up case, which incorporates an application device according to the invention.

The surface element 3 may be impregnated with product either before deformation of the surface element 3 or after the required shaping of the surface element. The product is contained, particularly in the form of a solid cake, in a container or case. A case 100 of this type is shown in FIG. 6. The surface element 3 is then applied to the lid of the right eye so as to transfer thereto all or part of the product carried by the surface element 3. After application, the user relaxes the pressure she was exerting on the actuation sites 18, 19 of the actuation elements 12, 13. The surface element 3 returns to its undeformed cross-sectional shape of FIG. 1A and 4B by means of elastic return, and the actuation elements 12, 13 return to their original positions.

Figure 3A:
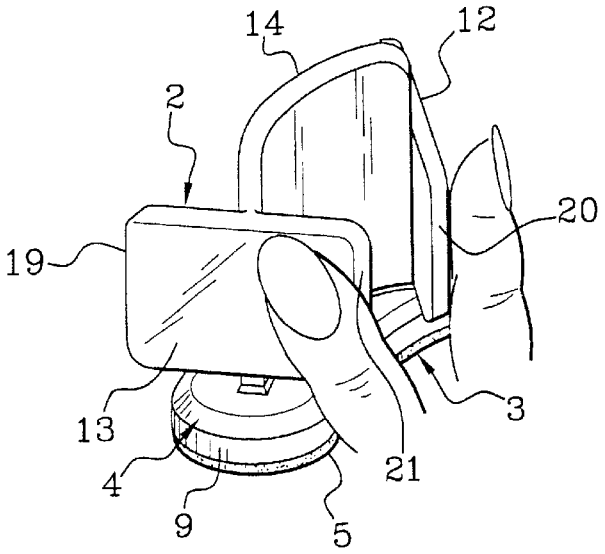
FIG. 3A is a perspective view of the application device of FIG. 1A as adapted for the application of a product to the lid of the left eye.
Figure 3B:
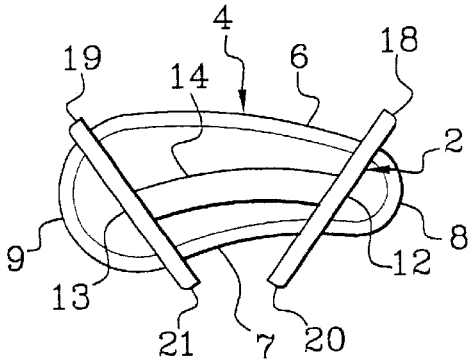
FIG. 3B is a rear view of the application device of FIG. 1A as adapted for the application of a product to the lid of the left eye.

A description will now be given of the use of the application device discussed hereinabove for making up the lid of the left eye, with reference to FIGS. 3A–3B and 4A. As is apparent from these FIGS, the user holds the application device 1 between her thumb and forefinger and moves the actuation sites 20, 21 of the actuation elements 12, 13 closer together. Conversely, the actuation sites 18 and 19 of the actuation elements 12, 13 move farther away from each other. In doing this, the linking element 14 flexes correspondingly, thereby giving rise to in-plane deformations of the applicator member 4 and of the surface element 3. The crosssectional shape of the surface element 3 is then asymmetrical. As shown in FIG. 4A, the cross-sectional shape of the surface element 3 is oriented in the opposite manner from the section of FIG. 4C. Thus, the lateral edge 6 now forms a radius of curvature greater than the curvature of the lateral edge 7.

Application of the product takes place in the same way as application of the product to the lid of the left eye. After application, the user relaxes the pressure she was exerting on the actuation sites 20, 21 of the actuation elements 12, 13. These actuation elements 12, 13 return to their original position, and the surface element 3 returns to its undeformed state, as shown in FIGS. 1A and 4B, by means of elastic return.

Figure 5A:
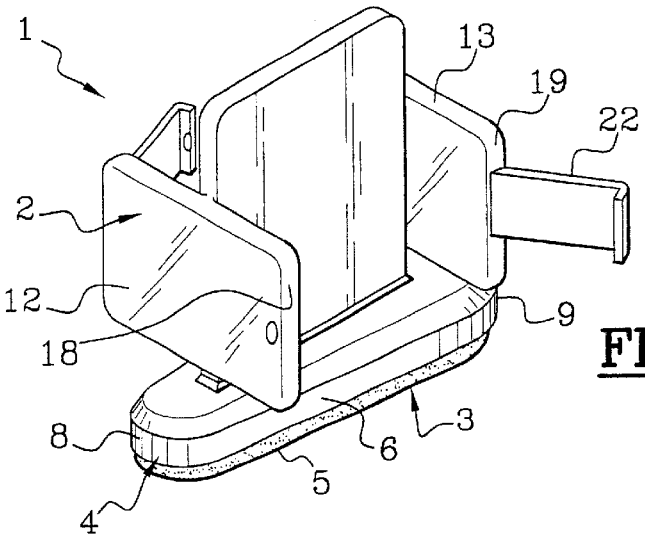
FIG. 5A is a perspective view of an application device according to a second preferred embodiment of the invention.
Figure 5B:
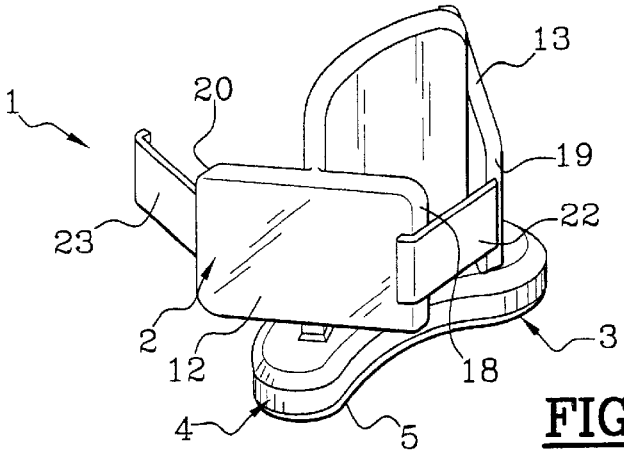
FIG. 5B is a perspective view of the application device of FIG. 5A in a first deformed and locked configuration.

FIGS. 5A–5B illustrate yet another preferred embodiment. According to this embodiment, the actuation site 19 of the actuation element 12 is connected via a film hinge to a first locking mechanism 22. The first locking mechanism 22 is configured, when the surface element 3 is in the form of FIG. 4C, to engage, by snap-fitting, with the actuation site 18 of the actuation element 13. With the first locking mechanism 22 so engaged, the application device is reversibly locked and the surface element 3 is maintained in the form that is suitable for application of product to the lid of the right eye (see FIG. 5B). Application of the product to the surface to be treated is thereby facilitated. According to this embodiment, the actuation site 20 of the actuation element 12 is connected via a film hinge to a second locking mechanism 23. The locking mechanism 23 is configured, when the surface element 3 is in the form shown in FIG. 4A, to engage the actuation site 21 of the actuation element 13. With the locking mechanism 23 so engaged, the application device is reversibly locked such that the surface element 3 in fixed its appropriate form for the treatment of the lid of the left eye.

FIG. 6 shows a case 100 including a base 101 and a lid 102 articulated to the base. The base 101 includes a first compartment 103 for receiving a solid cake of eyeshadow and a second compartment 104 for receiving an application device 1 according to the invention. A clasp 105 reversibly locks the lid 102 to the base 101. A mirror 106 may be adhesively bonded to the inner surface of the lid 102.

It will be apparent to those skilled in the art that various modifications and variations can be made to the structure and methodology of the present invention without departing from the scope or spirit of the invention. For example, the device of the present invention could be used to apply many different types of substances, including those that are not in the field of cosmetics. In addition, the application device could be configured from materials other than elastic materials. Thus, it should be understood that the invention is not limited to the examples discussed in the specification. Rather, the present invention is intended to cover modifications and variations of this invention, provided they fall within the scope of the following claims and their equivalents.

What is claimed is:

1. An application device comprising:

an applicator member formed at least partially of a deformable material, the applicator member including an application surface arranged substantially in a plane, the application surface having a first shape substantially parallel to the plane when the applicator member is undeformed and at least a second shape substantially parallel to the plane when the applicator member is deformed; and a grip configured such that force applied to the grip deforms the application surface from the first shape to the second shape.

2. The application device of claim 1, wherein the applicator member includes a deformable surface element, the application surface being on the surface element.

3. The application device of claim 2, wherein the surface element is formed from an absorbent material.

4. The application device of claim 3, wherein the absorbent material is chosen from open-cell foam and semi-open-cell foam.

5. The application device of claim 1, wherein the applicator member is at least partially formed of an elastically deformable material that returns the application surface to the first shape when the force is released from the grip.

6. The application device of claim 1, wherein the application surface has a third shape substantially parallel to the plane when the applicator member is deformed, and wherein the grip is configured such that a second force applied to the grip deforms the application surface element to the second shape.

7. The application device of claim 6, wherein the second shape is at least substantially a mirror image of the third shape.

8. The application device of claim 6, wherein the first and second shapes are asymmetrical.

9. The application device of claim 6, wherein the grip is configured to selectively cause the application surface to deform from the first shape to one of the second and the third shapes.

10. The application device of claim 6, wherein the first shape is defined by first and second at least substantially straight lateral edges extending from a first end to a second end of the application surface, the first and second lateral edges diverging from each other in the direction of the second end, the first and second ends being curved, and the second end having a radius of curvature greater than a radius of curvature of the first end.

11. The application device of claim 10, wherein the second shape is defined by the first lateral edge having a first radius of curvature and the second lateral edge having a second radius of curvature, the first radius of curvature being greater than the second radius of curvature.

12. The application device of claim 11, wherein the third shape is defined by the first lateral edge having a radius of curvature less than a radius of curvature of the second lateral edge.

13. The application device of claim 6, wherein the grip includes a first locking mechanism for releasably locking the application surface in the second shape and a second locking mechanism for releasably locking the application surface in the third shape.

14. The application device of claim 6, wherein the application surface in the second shape is adapted for the application of product to the lid of the right eye and in the third shape is adapted for the application of the product to the lid of the left eye.

15. A method of applying a product to at least one surface region, comprising:

providing the application device of claim 6;

placing product on the application surface;

applying a first force to the grip so that the application surface is deformed into the second shape;

transferring the product from the application surface to a first surface region; and releasing the first force from the grip.

16. The method of claim 15, wherein the method further comprises:

applying a second force to the grip so that the application surface is deformed into the third-shape;

transferring the product from the application surface to a second surface region; and releasing the second force from the grip.

17. The method of claim 16, wherein the product is eye make-up and wherein one of the first and second surface regions is on a left eyelid and the other of the first and second surface regions is on the right eyelid.

18. The application device of claim 1, wherein the grip is at least partially formed of a deformable material such that the force applied to the grip deforms the grip.

19. The application device of claim 18, wherein the grip is at least partially formed of an elastically deformable material that elastically returns the application surface to the first shape when the force is released from the grip.

20. The application device of claim 1, wherein the first shape is at least substantially a mirror image of the second shape.

21. The application device of claim 1, wherein the first shape is symmetric with respect to an axis of symmetry.

22. The application device of claim 1, wherein the first shape is defined by first and second lateral edges extending from a first end to a second end of the application surface, the first and second lateral edges diverging from each other in the direction of the second end.

23. The application device of claim 22, wherein the first and second lateral edges are at least substantially straight, and wherein the first and second ends are curved, the second end having a radius of curvature greater than a radius of curvature of the first end.

24. The application device of claim 23, wherein the second shape is defined by the first lateral edge having a first radius of curvature and the second lateral edge having a second radius of curvature, the first radius of curvature being greater than the second radius of curvature.

25. The application device of claim 1, wherein the grip is located on a side of the applicator member opposite the application surface.

26. The application device of claim 25, wherein the grip has at least one actuation element extending at least substantially perpendicular to the plane of the application surface.

27. The application device of claim 26, wherein the actuation element has at least one actuation site where the force is applied to cause the application surface to assume the second shape.

28. The application device of claim 26, wherein the application surface has a third shape substantially parallel to the plane when the applicator member is deformed, the at least one actuation element having a first actuation site where a first force is applied to cause the application surface to assume the second shape, and a second actuation site where a second force is applied to cause the application surface to assume the third shape.

29. The application device of claim 28, wherein the at least one actuation element includes a first actuation element and a second actuation element spaced from one another and extending at least substantially perpendicular to the plane of the application surface, each of the first and second actuation elements having a respective first actuation site for applying the first force and a respective second actuation site for applying the second force, such that applying the first force to the grip causes the first actuation sites of the first and second actuation elements to approach each other and applying the second force to the grip causes the second actuation sites of the first and second actuation elements to approach each other.

30. The application device of claim 25, wherein the at least one actuation element includes first and second actuation elements extending at least substantially perpendicular to the plane and to an axis of symmetry of the first shape.

31. The application device of claim 25, wherein the grip has a first and a second actuation element connected by a linking element arranged in a plane at least substantially perpendicular to the plane of the application surface.

32. The application device of claim 31, wherein the linking element is configured to flex elastically in a first direction in response to a first force applied to the grip and in a second opposite direction in response to a second force applied to the grip.

33. The application device of claim 32, wherein the first and second actuation elements are connected to the linking element by chamfered portions.

34. The application device of claim 31, wherein the linking element is thinner than the first and second actuation elements.

35. The application device of claim 31, wherein the linking element is more flexible than each of the first and second actuation elements.

36. The application device of claim 1, wherein the grip includes at least one locking mechanism for releasably locking the application surface in the second shape.

37. The application device of claim 1, wherein the grip is a single piece molded from one of a rigid and semi-rigid thermoplastic material.

38. The application device of claim 1, wherein the first shape is at least substantially symmetric with respect to an axis of symmetry and the second shape is asymmetric.

39. The application device of claim 1, wherein the first shape is asymmetric and the second shape is at least substantially the mirror image of the first shape.

40. An application system comprising:

the application device of claim 1; and a container containing the application device.

41. The system of claim 40, wherein the container is configured in the form of a case.

42. The system of claim 40, wherein the container further contains a cosmetic product.

43. The system of claim 42, wherein the cosmetic product is an eye make-up product.

44. The system of claim 42, wherein the container includes at least first and second compartments, wherein the first compartment contains the cosmetic product and the second compartment contains the application device.

45. The system of claim 40, wherein the container includes a lid having a mirror.

46. A method of applying a product to a surface region, comprising:

providing the application device of claim 1;

placing product on the application surface;

applying the force to the grip so that the application surface is deformed into the second shape;

transferring the product from the application surface to a surface region; and releasing the force from the grip.

47. The method of claim 46, wherein the product is eye make-up and the surface region is on one of a left and a right eyelid.

48. The method of claim 46, wherein the application surface elastically returns to the first shape when the force is released from the grip.

49. The application device of claim 1, wherein the applicator member is formed from a thermoplastic elastomer.

50. The application device of claim 49, wherein the thermoplastic elastomer is chosen from polypropylene and polyethylene.

51. The application device of claim 1, wherein the applicator member and the grip are formed by one of two-shot injection molding and overmolding.

* * * * *